US005655463A

United States Patent [19]

Good

[11] Patent Number: 5,655,463

[45] Date of Patent: Aug. 12, 1997

[54] APPARATUS AND METHOD FOR BURNING WASTE MATERIAL

[75] Inventor: Lewis D. Good, Caledonia, Mich.

[73] Assignee: Douglas Nagel, Grand Rapids, Mich.

[21] Appl. No.: 492,426

[22] Filed: Jun. 19, 1995

[51] Int. Cl.[6] ..... F23B 5/00

[52] U.S. Cl. ..... 110/211; 110/219; 110/248; 110/108

[58] Field of Search ..... 110/210, 211, 110/224, 229, 235, 248, 108, 110, 219, 346

[56] References Cited

U.S. PATENT DOCUMENTS

| | | |
|---|---|---|
| D. 317,648 | 6/1991 | Andersen et al. . |
| 1,160,360 | 11/1915 | Atterbury et al. . |
| 1,869,844 | 8/1932 | Derr . |
| 2,005,812 | 6/1935 | Thomas . |
| 2,103,488 | 12/1937 | Ohlsen . |

(List continued on next page.)

FOREIGN PATENT DOCUMENTS

| | | |
|---|---|---|
| 2839536 | 3/1980 | Australia . |
| 8201047 | 10/1982 | Belgium . |
| 2 036 908 | 2/1992 | Canada . |
| 2 043 845 | 7/1992 | Canada . |
| 396908 | 11/1990 | European Pat. Off. . |
| 555501 | 8/1993 | European Pat. Off. . |
| 640 709 | 1/1937 | Germany . |
| 1401889 | 3/1969 | Germany . |
| 1943855 | 3/1971 | Germany . |
| 158903 | 9/1984 | Japan . |
| 1074807 | 4/1986 | Japan . |
| 1495574 | 7/1989 | U.S.S.R. . |
| 1506224 | 9/1989 | U.S.S.R. . |
| 1525405 | 11/1989 | U.S.S.R. . |
| 20 418 | of 1907 | United Kingdom . |
| 926428 | 5/1963 | United Kingdom . |
| 216520 | 12/1984 | WIPO . |
| 5158243 | 3/1987 | WIPO . |

OTHER PUBLICATIONS

Exhibit A is a news article entitled "Expensive fixes may be coming at incinerator," publication date unknown, published in the Grand Rapids Press, author unknown, disclosing an EPA proposal to tighten restrictions on municipal incinerators.

Exhibit B is a paper entitled "Gasogens," published in Jul. 1962, original report data 1944, published by Forest Products Laboratory, Madison, Wisconsin in cooperation with the University of Wisconsin, disclosing gasification of wood and charcoal for generating a replacement for gasoline used in motor vehicles.

*Primary Examiner*—Henry A. Bennett
*Assistant Examiner*—Susanne C. Tinker
*Attorney, Agent, or Firm*—Price, Heneveld, Cooper, DeWitt & Litton

[57] ABSTRACT

A furnace includes a decomposition chamber configured to form a fire pit for controlled decomposition of combustible waste material, a preheat chamber connected to and located generally above the decomposition chamber, and an afterburn chamber operably connected to an outlet on the decomposition chamber. The decomposition chamber includes an inlet for allowing controlled input of air to the decomposition chamber to create an oxygen-starved environment. The outlet is positioned generally opposite the inlet on the decomposition chamber and adjacent the fire pit such that the gases from the preheat chamber and the decomposition chamber flow generally across the decomposition chamber and through the burning/decomposing waste materials in the fire pit. The afterburn chamber chamber operates with a vacuum such that the gases and vapors from the preheat chamber and the decomposition chamber are drawn through the fire pit such that they are treated by the hot decomposing matter in the fire pit. A heat exchanger and roaster are operably connected to the exhaust of the afterburn chamber. An input mechanism for controlling input of chopped waste materials is connected to the preheat chamber.

35 Claims, 4 Drawing Sheets

U.S. PATENT DOCUMENTS 2,442,950 6/1948 Harding .
2,483,918 10/1949 Martin .
2,653,213 9/1953 Comstock .
2,977,255 3/1961 Lowry .
3,336,884 8/1967 Fix et al. .
3,557,724 1/1971 Pan et al. .
3,581,684 6/1971 Hagersten et al. .
3,585,946 6/1971 Dahlund .
3,592,151 7/1971 Webber .
3,687,094 8/1972 Menigat .
3,785,304 1/1974 Stookey .
3,807,321 4/1974 Stockman .
3,831,349 8/1974 Siwersson et al. .
3,955,512 5/1976 Martin et al. .
4,015,546 4/1977 Paules .
4,029,485 6/1977 Siwersson et al. .
4,063,903 12/1977 Beningson et al. .
4,121,524 10/1978 Voelskow et al. .
4,205,614 6/1980 Good .
4,221,040 9/1980 Good .
4,253,405 3/1981 Cottrell et al. .
4,280,417 7/1981 Alexandersson .
4,285,282 8/1981 Good .
4,437,419 3/1984 Hertel .
4,452,154 6/1984 Kono et al. .
4,494,469 1/1985 da Silva Pinto .
4,531,463 7/1985 Kratz et al. .
4,561,363 12/1985 Mallek .
4,622,903 11/1986 Warren et al. .
4,739,715 4/1988 Couarc'h et al. ..... 110/346
4,777,889 10/1988 Smith .
4,784,603 11/1988 Robak, Jr. et al. .
4,821,653 4/1989 Jones ..... 110/210 X
4,924,785 5/1990 Schultz et al. .
4,932,336 6/1990 Srowig et al. ..... 110/346
4,940,010 7/1990 Kubin et al. .
4,981,090 1/1991 Andersen .
4,987,840 1/1991 Honda .
5,082,572 1/1992 Schmidt .
5,092,254 3/1992 Kubin et al. .
5,185,134 2/1993 Gullett ..... 110/346 X
5,186,622 2/1993 Gillespie et al. .
5,195,449 3/1993 Michimae .
5,279,234 1/1994 Bender et al. ..... 110/210
5,315,937 5/1994 Williams .
5,372,077 12/1994 Yen et al. .
5,411,714 5/1995 Wu et al. ..... 110/110 X

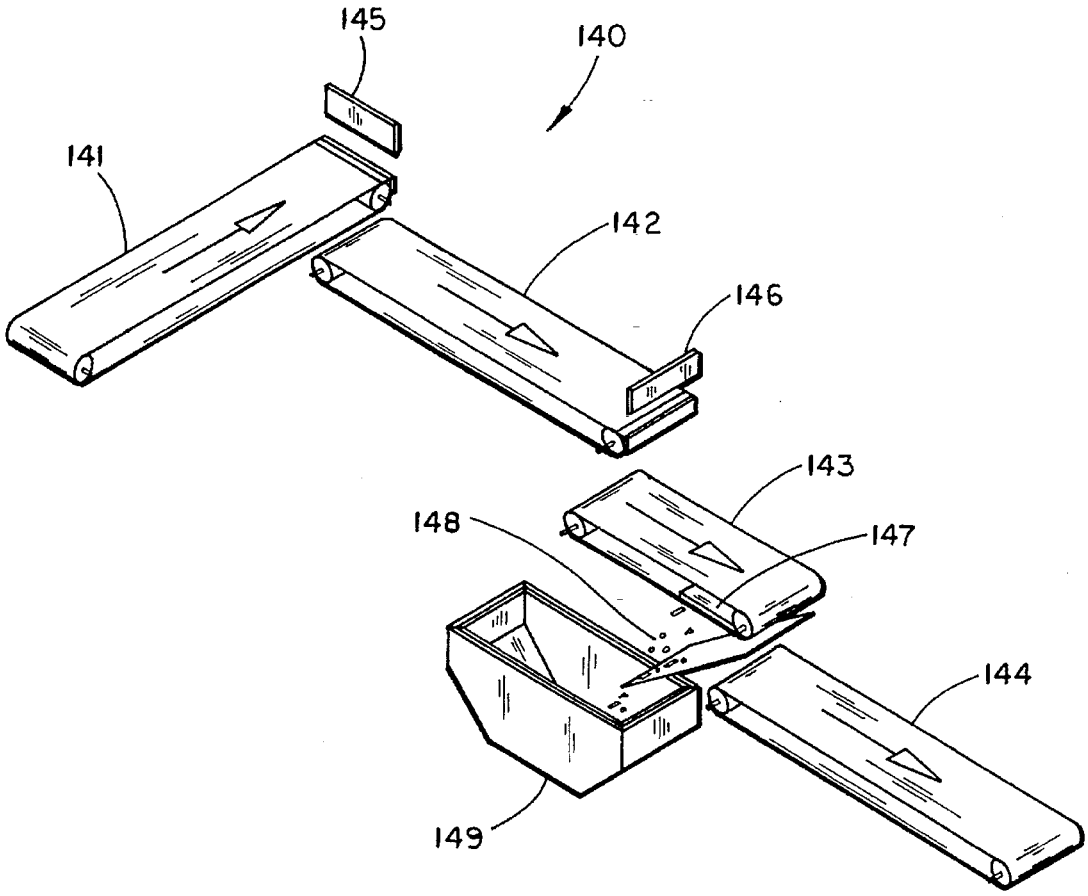
FIG.7
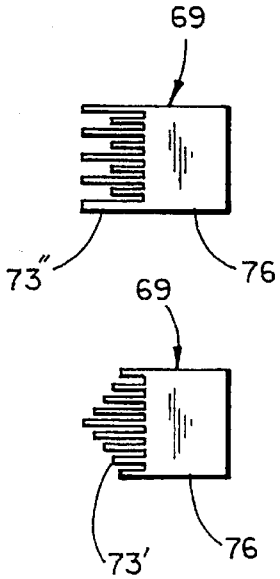
FIG.3
FIG.2

APPARATUS AND METHOD FOR BURNING WASTE MATERIAL

BACKGROUND OF THE INVENTION

The present invention concerns an apparatus and method for burning waste material, and more particularly concerns an apparatus and method adapted to bum combustible and semicombustible trash and the like.

Modern civilizations generate a tremendous amount of rubbish and trash, which will be referred to herein as waste products. The waste products come from a variety of industrial and domestic sources, and usually comprise a wide variety of materials. Land filling these waste products is becoming increasingly expensive and also is now considered environmentally undesirable. Incineration and/or burning the waste materials is an attractive alternative since it can be done relatively close to the source of the waste material. Further, the energy to incinerate can come in part from the waste material itself. However, there are problems with incineration and/or burning of waste materials.

A major problem is that the waste materials collected in volume are very non-uniform, especially those collected at public collection centers, such that there is a great variation in properties of the waste product such as combustibility, BTU content, percent of uncombustible matter, and potential resultant pollutants from the burning/incineration process. Existing municipal incineration facilities have attempted to overcome the problems of incinerating/burning the inconsistent waste material by addition of fuel, additives and/or externally supplied heat to the burning process. Also, many facilities sort waste material before feeding it into the incinerator. However, sorting input waste material is expensive and messy. Further, large and expensive emission control systems capable of handling wide variations in emissions must still be used since, in known municipal incineration facilities for waste materials, the burning process varies greatly in temperature, in heat generation and in pollutant types and quantities that are generated.

Thus, an apparatus for and method of decomposing and/or burning waste materials of varying quality and content solving the aforementioned problems is desired that is efficient, environmentally acceptable, continuous, and readily controllable.

SUMMARY OF THE INVENTION

The present invention includes an apparatus for decomposing waste materials. The apparatus includes a decomposition chamber configured to form a fire pit for controlled decomposition of combustible waste material. The decomposition chamber includes an inlet for allowing controlled input of air to the decomposition chamber to create an oxygen limited burning and decomposition process in the decomposition chamber, and further includes a gaseous by-product outlet positioned generally opposite the inlet adjacent the fire pit for output of combustible gaseous by-products generated by the decomposing waste material in the fire pit. The apparatus further includes a preheat chamber connected to the composition chamber for providing controlled input and preheating of raw waste material to the decomposition chamber, and still further includes an afterburn chamber operably connected to the outlet of the decomposition chamber for burning the combustible gaseous by-products generated in the decomposition chamber. The afterburn chamber is configured to operate with at least a partial vacuum such that the gaseous by-products and other vapors generated in the preheat chamber and the decomposition chamber are drawn generally through the hot decomposing waste materials in the decomposition chamber and into the afterburn chamber.

These and other features, advantages and objects of the present invention will be further understood and appreciated by those skilled in the art by reference to the following specification, claims and appended drawings.

BRIEF DESCRIPTION OF THE DRAWINGS

FIGS. 2–3 are plan views of alternative control doors for controlling the waste material being fed into the apparatus;

FIG. 7 is a perspective view of a material handling device for use with the present apparatus.

DETAILED DESCRIPTION OF PREFERRED EMBODIMENT

Figure 1:
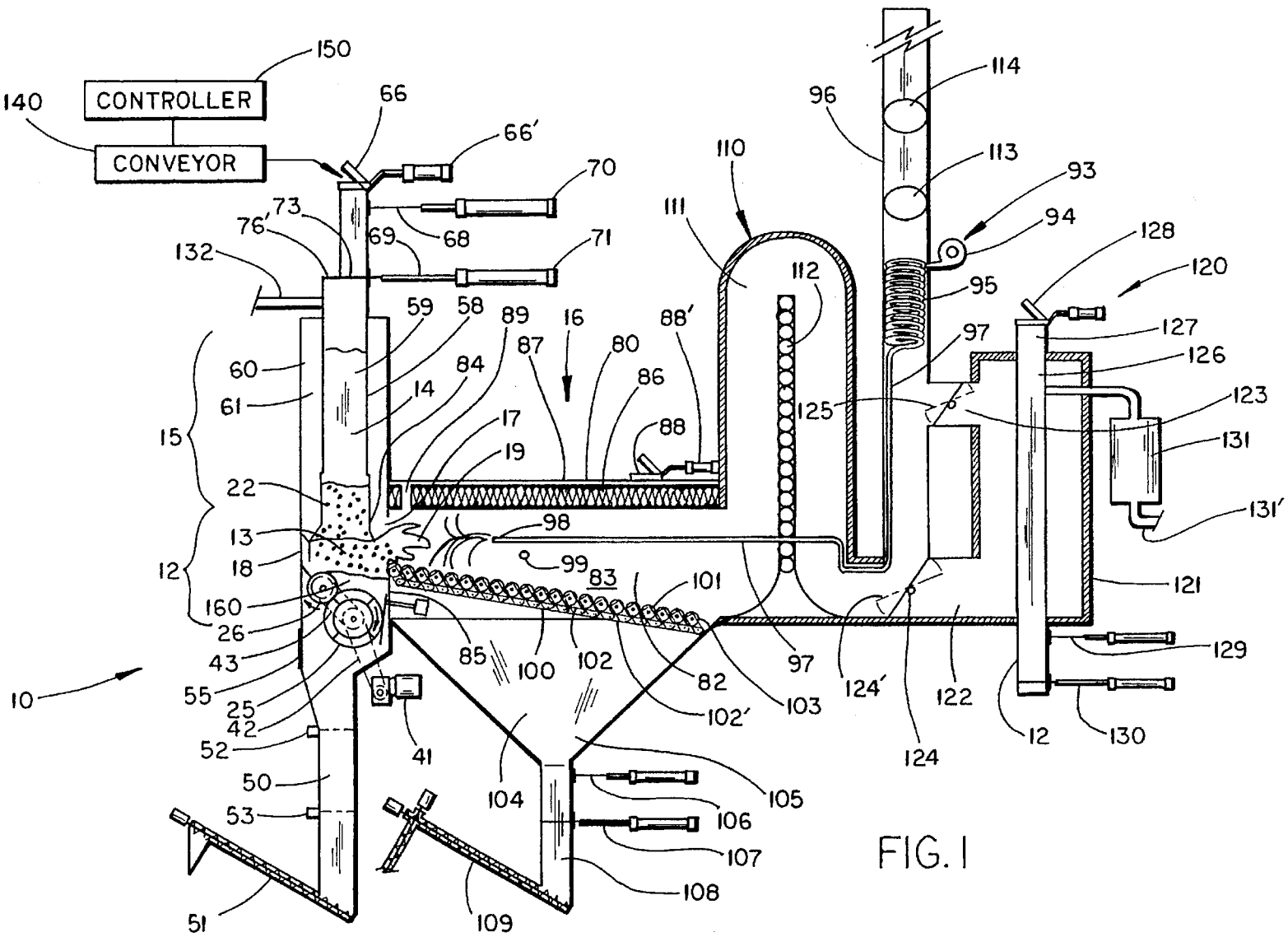
FIG. 1 is a schematic elevational view of an apparatus embodying the present invention.

An apparatus 10 (FIG. 1) embodying the present invention includes a decomposition chamber 12 configured to form a fire pit 13 for controlled decomposition of combustible and semicombustible waste material 14, a preheat chamber 15 connected to and located generally above decomposition chamber 12, and an afterburn chamber 16 operably connected to a gaseous by-product outlet 17 on decomposition chamber 12. The decomposition chamber 12 includes an inlet 18 for allowing controlled input of air to the decomposition chamber to create an oxygen limited environment in the decomposition chamber 12. The outlet 17 is positioned generally opposite the inlet 18 and adjacent the fire pit 13 such that the by-product gases from the fire pit 13 flow generally across the fire pit 13 and through waste materials decomposing at high temperature therein. The afterburn chamber 16 operates with a partial vacuum such that gases and vapors 19 from the preheat chamber 15 and the decomposition chamber 12 are drawn through the fire pit 13 such that they are treated by the hot decomposing matter in the fire pit 13. The process advantageously "cleans" the gaseous by-products being fed into the afterburn chamber 16 such that the burned output or exhaust of the afterburn chamber 16 is environmentally relatively clean and consistent such that standard and non-oversized industrial emissions control equipment, if needed, can effectively and efficiently handle the emitted exhaust. The illustrated apparatus 10 is particularly constructed for burning municipal waste, including domestic and industrial wastes typically generated around cities and towns. For example, the present invention and apparatus is believed to be particularly useful as a municipal waste burning facility, however the scope of the invention is not limited to only this one application. Advantageously, the exhaust from the present process is believed to be surprisingly and unexpectedly clean and free from pollutants and unacceptable emissions.

Figure 5:
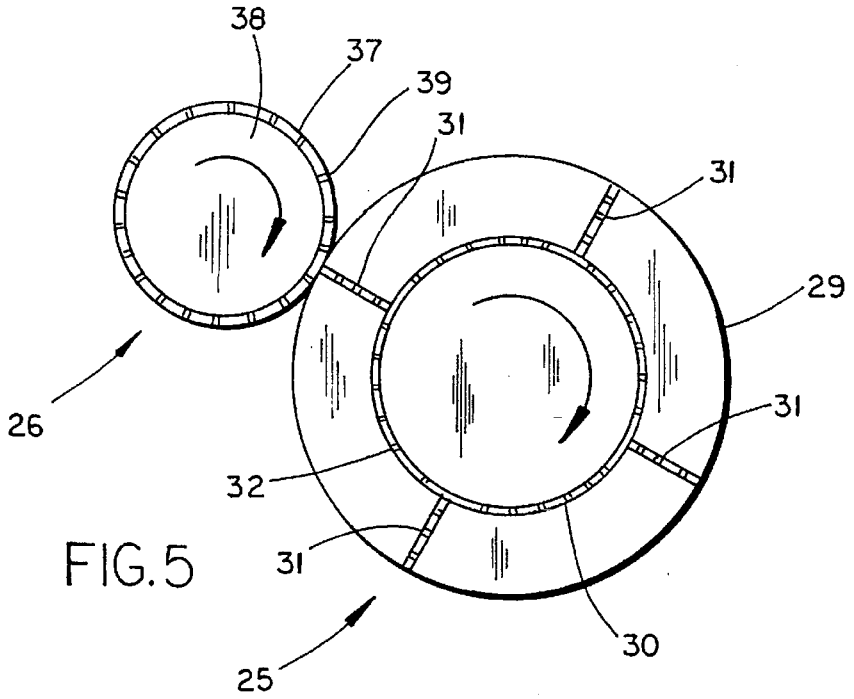
FIGS. 5–6 are a cross-sectional side and perspective views of the co-rotating drams shown in FIG. 1.
Figure 6:
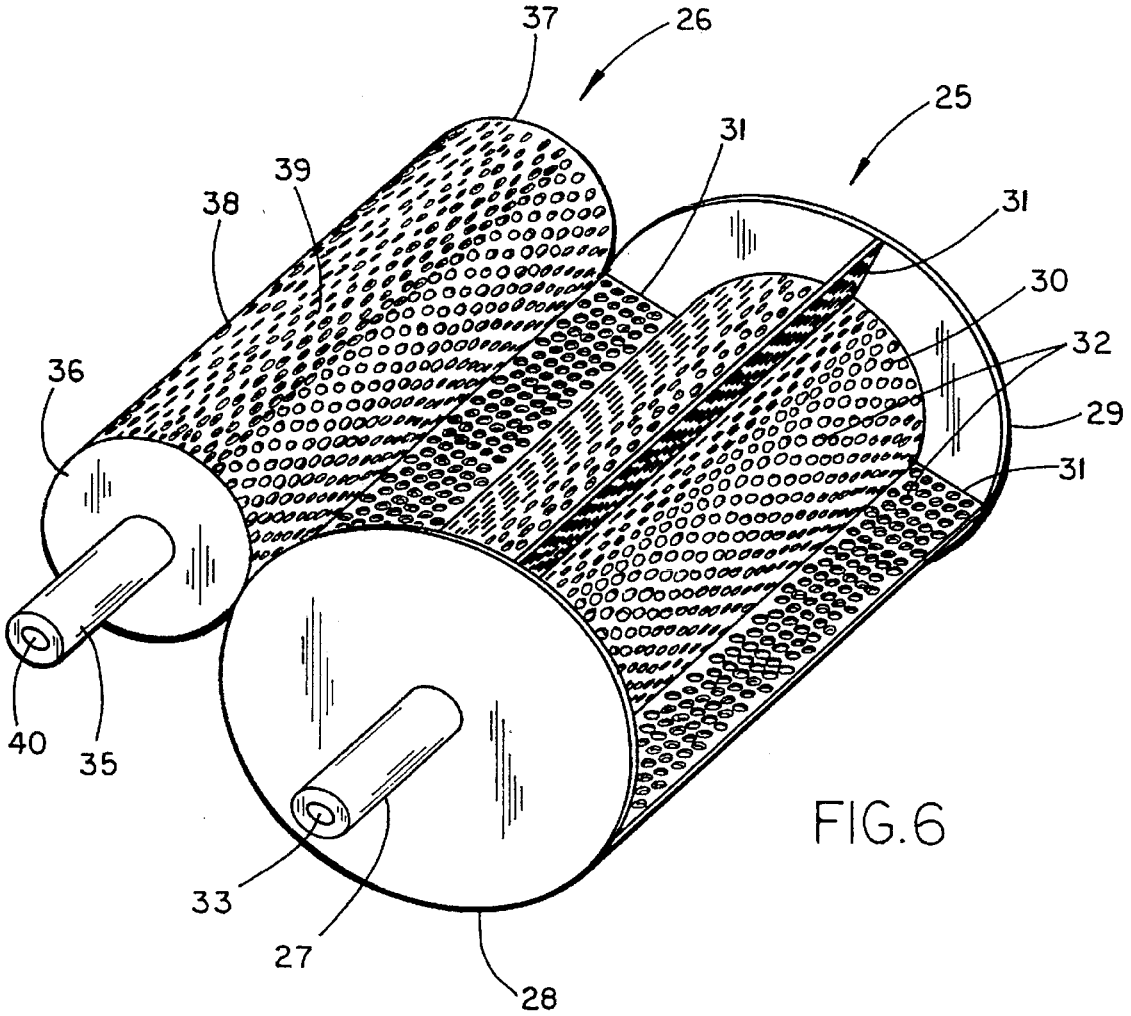

Decomposition chamber 12 (FIG. 4) includes an upper "distillation" chamber portion 22 and a lower fire-pit-forming chamber portion 23. Lower chamber portion 23 includes sidewalls 24 defining a box-like shape. A pair of rotatable drums 25 and 26 are operably positioned in lower chamber portion 23 and form a bottom to the fire pit 13. Drums 25 and 26 are positioned adjacent each other, but are apertured (see FIGS. 5–6) so that air can pass therethrough as described below.

Figure 4:
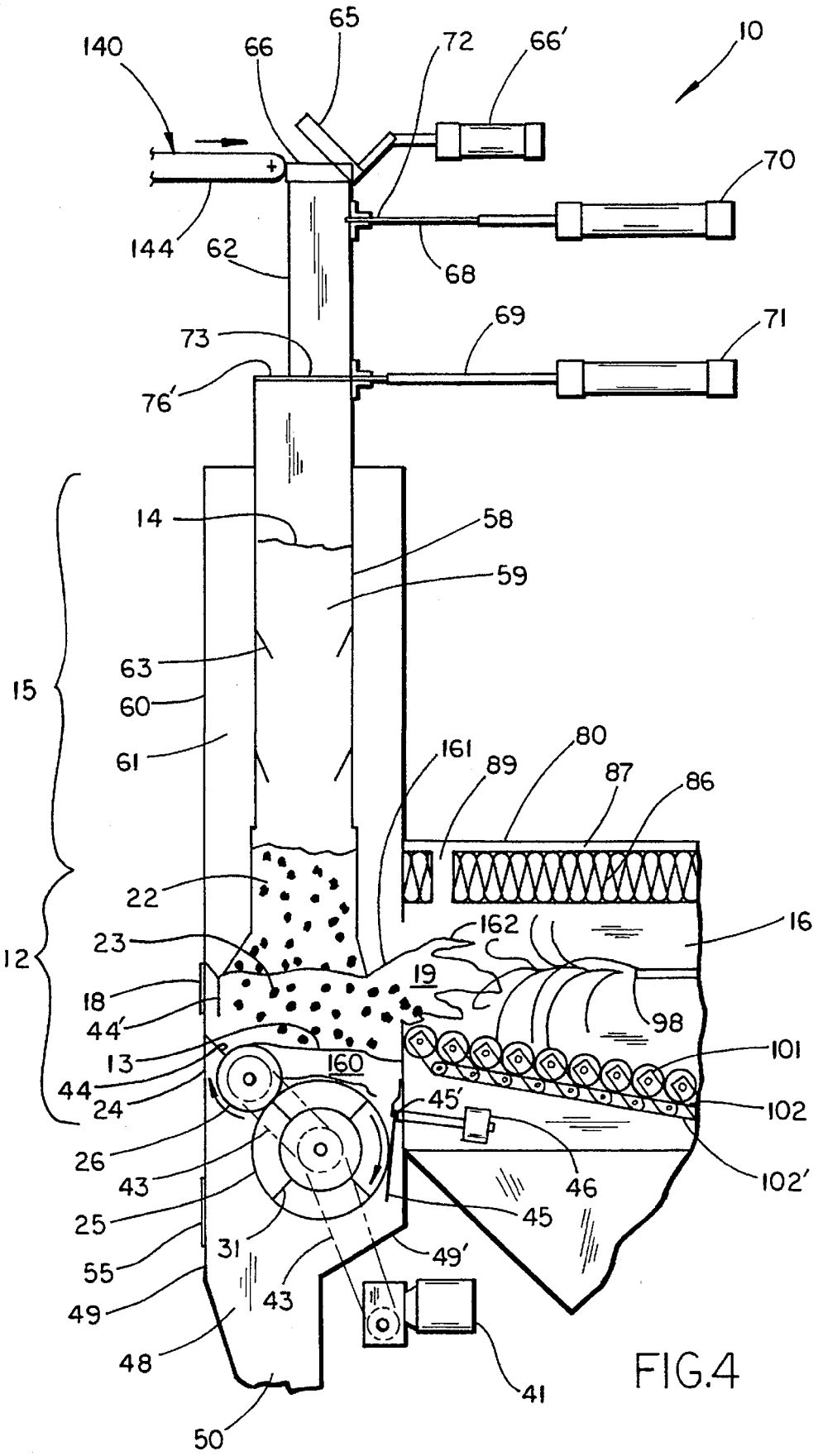
FIG. 4 is an enlarged fragmentary view of the decomposition chamber shown in FIG. 1.

Primary drum 25 (FIG. 6) includes an axle 27, a pair of spaced apart end plates 28 and 29 secured to axle 27, and a hollow barrel-shaped cylinder 30 connected between end plates 28 and 29. A plurality of paddles 31 extend between end plates 28 and 29, and further extend radially from cylinder 30. Four paddles 31 are shown, although any number of paddles can be used. Cylinder 30 and paddles 31 include a plurality of apertures 32 for allowing air to pass therethrough. Axle 27 is hollow and defines an axially extending passageway 33 for receiving cooling fluid or air therethrough. Further, axle 27 is operably supported by bearings adjacent chamber sidewall 24 in decomposition chamber 12 (FIG. 4).

Drum 26 (FIG. 6) is somewhat smaller in diameter than drum 25 and is located diagonally above primary drum 25 in decomposition chamber 12 at about a 45° angle thereabove. However, it is noted that various sizes and arrangements of drums are contemplated to be within the scope of the present invention. Drum 26 includes an axle 35, a pair of spaced apart end plates 36 and 37 attached to axle 35, and a hollow barrel-shaped cylinder 38. Cylinder 38 includes apertures 39 for allowing air to pass therethrough. Axle 35 is hollow and defines an axially extending passageway 40 for receiving cooling fluid or air therethrough. Axle 35 is also supported on chamber sidewalls 24 (FIG. 4).

A variable drive motor 41 (FIG. 4) is operably connected to drums 25 and 26 by chains 42 and 43, respectively. Drive motor 41 rotates drums 25 and 26 at a relatively slow rotational speed or creep of about 1 revolution every few minutes, depending on the characteristics of the burning process and the waste material being consumed within decomposition chamber 12. The rotation of drums 25 and 26 can be a continuous or a stepped motion, but should be sufficiently slow such that substantially only ash is dumped from the downstream side of drum 25. Also preferably, drum 26 rotates at a rotational speed that delivers waste material 14 onto primary drum 26 without compacting the waste material 14, but so that pockets and voids within fire pit 13 on drum 26 are avoided. The rotational speed of drum 26 is greater than drum 25, but the tangential speed at the outer edge of drum 26 is about equal to or only slightly greater than drum 25. Drums 25 and 26, in addition to substantially preventing voids and non-uniform pockets within fire pit 13, also provide an amount of agitation and movement to facilitate a continuous process within decomposition chamber 12. As the burning and decomposing process stabilizes, the apertures in drums 25 and 26 are partially covered to act as a natural valve to control flow of air through the drums 25 and 26, as noted below.

An inclined deflector 44 (FIG. 4) extends from sidewall 24 and is positioned to deflect waste material 14 onto feed drum 26. The air inlet 18 is located generally above and proximate deflector 44, and includes a wall section 44' spaced inwardly from sidewall 24 for holding waste material 14 away from air inlet 18. Another deflector 45 is operably supported on sidewall 24 adjacent the downstream side of primary drum 25. Deflector 45 is moveable about a hinge 45', and is biased against drum 25 by a counter weight 46 such that it acts like a trap door. As chunks of non-combustible material including ash and clinkers are moved against deflector 45, deflector 45 allows the non-combustible material to fall below drum 25 into a collection pit 48 under drums 25 and 26.

Collection pit 48 (FIG. 4) includes sidewalls 49 including angled sidewall 49' that directs the non-combustible material into a holding/collection chamber 50. An auger 51 (FIG. 1) or other means is positioned at the bottom of collection tank 50 to handle the ash collected therein. A high ash level sensor 52 and a low ash level sensor 53 are positioned in holding/collection chamber 50 for controlling actuation of auger 51. Collection pit 48 and auger 51 define a sealed system capable of maintaining the vacuum generated within decomposition chamber 12. A controlled air intake or inlet 55 is located in sidewall 49 of collection pit 50 or is located in the sidewall 24 of decomposition chamber 12 under drum 26. Air intake 55 is configured to feed a controlled amount of air into collection pit 48 and upwardly through drums 25 and 26 into decomposition chamber 12. Notably, the ash and other material resting on drums 25 and 26 tends to at least partially seal the apertures 33 in the drums, so as to act as a natural valve for controlling the flow air through drums 25 and 26.

Preheat chamber 15 (FIG. 4) includes an elongated inner tubular sidewall 58 defining an inner chamber 59, and an outer tubular sidewall 60 formed around inner sidewall 58 forming an outer chamber 61. Outer chamber 61 receives high temperature preheating air from decomposition chamber 12 for preheating waste material 14 within inner chamber 59. Waste material 14 is fed by gravity into preheat chamber 15 along an input chute or feed stack 62. As the waste material 14 accumulates, it builds up within preheat chamber 15. The weight of the waste material 14 causes the material to flow toward the decomposition chamber 12. Deflectors 63 can be located within preheat chamber 59 to reduce the tendency of the waste material within the preheat chamber 15 to undesirably compact the waste material in the fire pit 13. Deflectors 63 also control the flow of the waste material through preheat chamber 15. Alternatively, a conveyor or material handling/moving system can be used, such as if the apparatus 10 is positioned with the preheat chamber 15 extending horizontally or at an angle from a side of the decomposition chamber 12.

A cover 65 (FIG. 4) is operably mounted to input chute 62 and is configured to sealingly cover the input aperture 66 of chute 62. An actuator 66' controls the movement of cover 65 in conjunction with material handling equipment 140. A pair of reciprocatable gates or control doors 68 and 69 are positioned within chute 62. Doors 68 and 69 are spaced apart along chute 62, and are controlled by actuators 70 and 71, respectively. By alternatingly extending and retracting the door 68 and 69, waste material 14 fed into input aperture 62 is dropped along chute 62 at a controlled stepped rate. This prevents the waste material from undesirably disrupting the flow of material through preheat chamber 15 and within decomposition chamber 12. As illustrated, door 68 is shown in an open position and door 69 is shown in a closed position. At least door 69 include fingers 73 that extend into chute 62. Fingers 73 can be arranged in various configurations, such as the V-shaped arrangement of fingers 73' shown in FIG. 2, or the alternating length arrangement of finger 73" shown in FIG. 3. The base of door 69 includes a shelf portion 76. In the illustrated arrangement, door 69 is positioned at the juncture of the chute 62 and the preheat chamber 15. Preheat chamber 15 is larger than chute 62 and forms an offset 76' such that when door 69 is fully extended, the shelf 76 seals off chute 62 to prevent undesirable inflow of air into partial-vacuum-operated preheat chamber 15 and decomposition chamber 12. At the same time, the offset 76' receives fingers 73 such that fingers 73 are at all times retained fully within preheat chamber 15 such that any waste material caught thereon does not prevent the operation of door 69. A wiper bar or other means can be used to wipe waste material caught on hand 69 off from fingers 73 as door 69 is reciprocatingly retracted.

Afterburn chamber 16 (FIG. 1) is positioned adjacent decomposition chamber 12, and includes an upper wall 80, a lower wall 81, and sidewalls 82 forming a burning chamber. Walls 80, 81 and 82 are connected to sidewall 24 of decomposition chamber 12 around gaseous by-product outlet 17. Outlet 17 is formed in part by the lower end 84 of preheat chamber inner wall 58 and also in part by an upper downstream edge 85 of decomposition chamber sidewall 24. A layer of insulating firebrick 86 is lined along upper wall 80 to insulate afterburn chamber 16. A passageway 87 is formed between upper wall 80 and firebrick 86. Air flows into passageway 87 through an inlet 88 located at a downstream end of upper wall 80. The air flowing into inlet 88 is controlled by an actuator 88'. The air flows through passageway 87 out of a secondary outlet 89 located proximate decomposition outlet 17 into afterburn chamber 16. The flow of this air is such that it assists in creating turbulence of the gases flowing from decomposition chamber 12 through gaseous by-product outlet 17 into afterburn chamber 16.

Air is also input into afterburn chamber 16 by a forced air system 93. Forced air system 93 includes a blower 94, a heat recovery duct 95 located in exhaust stack 96, and a feed line 97 that extends from heat recovery duct 95 into afterburn chamber 16. The end 98 of feed line 97 is located proximate outlet 17 and is directed into the flow of by-product gases coming from decomposition chamber 17 into afterburn chamber 16 through aperture 17. The flow of air from end 98 creates a turbulent flow to promote complete combustion within afterburn chamber 16. An ignitor 99 is located proximate end 98 to ignite a fire in afterburn chamber 16 during start up or to provide a permanent "pilot light" to prevent interrupted burning of the gas from chamber 12. It is noted that ignitor 99 need not supply a significant amount of heat or energy to the process.

A floor 100 comprising a plurality of rollers 101 made of firebrick-like material extends at a generally downwardly sloping angle from gaseous by-product outlet 17. Rollers 101 are mounted on holders 102 on a side bar 102'. Fly ash is passed between rollers 101 and/or is passed along rollers 101 to a downstream end 103. Rollers 101 operate at an identical rotational speed or at an increased speed in the downstream direction so that non-combustibles or clinkers that enter afterburn chamber 16 are passed along rollers 101 and fall off end 103. Materials falling through rollers 101 or off the downstream end 103 fall into an ash collection area 104. Lower wall 81 of afterburn chamber 16 includes funnel-like sidewall sections 105 defining the ash collection area 104. A pair of spaced apart gates 106 and 107 are positioned at the bottom of collection area 104 and are reciprocatable for dropping the ash therethrough into a chute 108. An auger 109 or other means is positioned at the bottom of chute 108. Auger 109 is operable to remove ash from chute 108. At least one of the gates 106 and 107 are closed at all times to maintain the vacuum within afterburn chamber 16. Notably, floor 100 separates afterburn chamber 16 from ash collection area 104 such that there is sufficiently low air movement in ash collection area 104 so that the fly ash will settle within ash collection area 104.

A heat exchanger 110 (FIG. 1) receives the exhaust gases from afterburn chamber 16 and directs the exhaust gases along a path 111 to exhaust stack 96. The illustrated path 111 defines an inverted U-shape having heat absorbing members 112 positioned within the U-shape. However, it is contemplated that a variety of different heat exchangers having multiple looped branches can be used. Exhaust gases travel through heat exchanger 110 to stack 96, and travel naturally upwardly through stack 96 where they are treated by emission control equipment such as scrubber 113. A forced air fan 114 is included in stack 96 to assist in start up of apparatus 10 to initiate flow of gases within apparatus 10. It is contemplated that the natural flow of gases up stack 96 will create a sufficient vacuum to draw vapor and decomposition gases from preheat chamber 15 and afterburn chamber 16 once a continuous operating process is established.

A roaster 120 (FIG. 1) is operably connected to stack 96 for burning combustible waste from metal containing waste. Roaster 120 is preferable for waste materials where the metal therein is preferably not raised above a predetermined temperature, such as to prevent oxidization or chemical change in the metal that would reduce its value as recyclable material. For example, domestic soup cans represent such a waste product. Roaster 120 includes a heating chamber 121, and further includes an inlet and an outlet 122 and 123 that extend from opposing ends of heating chamber 121 and are operably connected to stack 96. Valves 124 and 125 are positioned in the inlet and outlet 122 and 123, respectively, to control the flow of exhaust through roaster heating chamber 121 and to thus control the temperature within roaster chamber 120. At least inlet 122 includes a deflector 124' that extends into the flow of gases coming from afterburn chamber 16 to cause a positive flow of gases through roaster 120. A roaster chamber 126 extends through heating chamber 121. Waste material to be roasted is input through waste material inlet 127. A cover 128 is operably attached to inlet 127 to prevent undesirable loss of emissions therefrom. A pair of reciprocatable gates 129 and 130 at the bottom of roaster chamber 126 control the outflow of waste material from roaster chamber 126. The exhaust from roaster chamber 126 is fed through a bed of activated coke 131 and is then routed through duct 131' to the preheat chamber 15 such as at location 132. Alternatively, it is contemplated that the roaster exhaust could be fed into the afterburn chamber 16 as part of the input from forced air system 93, or could be fed into the decomposition chamber 12 as part of air from inlet 18 or inlet 55. Notably, additives such as preheated steam can be added through location 132 to preheat chamber 15 to control the hot burning process in fire pit 13. Alternatively, high carbon materials such as tires, rubber or coal can be added when needed to trash having high water content.

A material handling apparatus 140 (FIG. 7) includes first, second, third and fourth conveyors 141, 142, 143 and 144 for conveying waste material therealong to be fed into apparatus 10. Conveyors 141 and 142 are oriented at perpendicular angles and include choppers 145 and 146 located at respective downstream ends of conveyors 141 and 142. Chopper 145 cuts waste material traveling along conveyor 141 into strips in a first direction. The strips of waste material drop lengthwise onto conveyor 142 and travel along conveyor 142 to the end thereof whereat they are chopped in a perpendicular direction by chopper 146. Preferably, the waste material is chopped into a size range of about 4"×4", although various sizes may be formed depending on the content of the incoming waste material. The chopped waste material is dropped from conveyor 142 onto conveyor 143 which includes a magnetic separator 147 for separating magnetically collectable metal material 148 from the chopped waste material. The separated magnetically collectable material is dropped into a collection bin 149. This collected metal material can be cleaned in roaster 120 if desired. The remaining material moves along conveyor 143 and is dropped onto conveyor 144 for controlled input into input aperture 66 of chute 62. It is contemplated that conveyor 144 and cover 65 (FIG. 1) can be controlled automatically, such as by use of a microprocessor or controller 150 controlling apparatus 10, or alternatively, can be controlled manually. Further, each of doors 68 and 69, drive motor 41, blower 94 and roaster 120 and other controls on apparatus 10 can be controlled automatically by a microprocessor or controller, or can be controlled manually.

Particular start up procedures for apparatus 10 depend on the material to be burned, and the design of the apparatus at particular applications. For example, it is contemplated that decomposition chamber 12 can be initially fired by starter material placed within decomposition chamber 12, and by establishing a natural flow of air by actuation of forced air fan 114 within exhaust stack 96. A red hot mass of decomposing material of about 600° F. including active carbon and having an oxygen limited atmosphere must be established. It is noted that the present apparatus is constructed to satisfactorily bum waste material including a wide variety of domestic products such as paper, telephone books, disposable food containers, packaging, wood, wet grass and lawn rubbish, broken toys, automotive parts such as tires and cables, and other junk including combustible matter, and including a wide variety of industrial products such as defective automotive parts including combustible components, packaging, shipping materials, wood pallets and other combustible or semicombustible junk.

Apparatus 10 can be operated as follows, though it is noted that other operating procedures are also contemplated to be within the scope of the present invention. Waste material is prepared by material handling apparatus 140 which chops the waste material into a desired maximum size and separates magnetically collectable material therefrom. Waste material 14 is then fed into input apparatus 66 of chute 62 by material handling apparatus 140, and falls onto door 68. Cover 65 is closed to seal chute 62. Door 68 is then opened slowly to cause the waste material 14 to drop in pieces onto door 69. Door 68 is then closed, and door 69 is slowly opened to cause the waste material 14 to drop onto the waste material already within preheat chamber 15. As the waste material 14 is consumed in the decomposition chamber 12, the waste material within the preheat chamber 15 flows by gravity toward fire pit 13. The preheat chamber 15 causes the waste material to gradually heat up as the waste material moves toward the fire pit 13. Depending on the content of the waste material and the characteristics of the apparatus 10, preheat chamber 15 preheats the waste material to a temperature of at least about 250° F. to 350° F. or above at the lower end. A significant amount of vapors and gases are driven off from the waste product as the temperature of the waste material exceed 212° F. These vapors and gases tend to collection in preheat chamber 12, but the doors 68 and 69 prevent escape of these vapors and gases from preheat chamber 15. Further, it is noted that decomposition chamber 12 and afterburn chamber 16 are operated at a partial vacuum of about 0.14 inches of water or more such that the vapor and gases are drawn along with the waste material as it travels through preheat chamber 15.

A red hot bed of decomposing material 160 having a temperature of about 600° F. to 1000° F. is formed in fire pit 13 on drums 25 and 26. It is noted that if the apparatus 10 is operated at a temperature of about 600° F., there are advantages in terms of handling mercury pollutants since the mercury pollutants are less volatile. The lower portion 160 of the bed of decomposing material in fire pit 13 includes a high ash content, and is substantially ash and/or uncombustible material and/or clinkers as it reaches the trapped door deflector 45. Drums 25 and 26 are rotated at a slow creeping rate such that substantially only ash and uncombustible and clinker materials are moved against deflector 45. The movement of drums 25 and 26 assures that the hot decomposing waste material 160 does not form pockets or voids therein which would be detrimental to the continuous process of decomposition in fire pit 13. Thus, the decomposition process is substantially a continuous uninterrupted process. Air is drawn primarily through air inlet 18 across the hot bed 160 toward the gaseous by-product outlet 17. However, air and vapors are also drawn from preheat chamber 15 and from lower area inlet 55 under drums 25 and 26. Notably, heat from decomposition chamber 12 circulates in outer chamber 61 of preheat chamber 15 for heating the inner chamber 59. The air movement is controlled such that the decomposition of hot bed 160 takes place in an oxygen limited environment. This causes a substantial amount of carbon monoxide and other combustible gases to be formed. Steam, such as from the evaporated moisture in waste material 14 or from the added steam from inlet 132, breaks down at least in part into hydrogen and oxygen, which oxygen is used in the decomposition process to form carbon monoxide. Addition of high content carbon to the waste material 14, such as inclusion of chopped automotive tires, may be useful to promote a good burn in the fire pit 13, although this is not normally required based on preliminary testing. Notably, vapors from preheat chamber 15 are drawn through the hot bed 160 before entering the gaseous by-product outlet 17, such that the vapors are treated by the hot bed, which includes some live carbon.

As the gaseous by-products 161, which are believed to be primarily CO, $H_2$ and other combustible gases, flow through by-product outlet 17, they are ignited by blue flame 162 burning in afterburn chamber 16. The turbulence caused by the forced air system 93 creates a complete and efficient combustion of the gases flowing into afterburn chamber 16. The temperature within afterburn chamber ranges from about 2000° F. to 3000° F. and the vacuum is operated at about 0.14 inches water. Afterburn chamber 16 is heavily insulated to maintain the temperature and uniformity of the decomposition process. Also, the entire process of burning/decomposing the waste material and treating the gaseous by-products and vapors formed in the preheat chamber 15, the decomposition chamber 12 and the afterburn chamber 16 is carefully controlled to provide a continuous uniform process having a continuously increasing temperature, and a continuous but limited air input. The waste material is carefully input and the flow is naturally controlled by the apparatus 10. Removal of ash is done without disturbing the flow of the waste material and without disturbing the flow of gases within the process. Preliminary testing of a prototype embodying the principles of the present apparatus has provided surprising and unexpectedly excellent results in terms of its ability to handle a wide variety and mix of waste products. For example, even waste material having large percentages of wet green fresh lawn grass have been burned without disrupting the burning process and without generating large amounts of visible smoke and unacceptable by-products. The exhaust flows from afterburn chamber 16 through heat exchanger 110 to exhaust stacks 96, where the exhaust is scrubbed as needed. Exhaust is redirected through roaster 120 by valves 124 and 125 as desired.

In the foregoing description, it will be readily appreciated by those skilled in the art that modifications may be made to the invention without departing from the concepts disclosed herein. Such modifications are to be considered as covered by the following claims, unless these claims by their language expressly state otherwise.

The embodiments of the invention in which an exclusive property or privilege is claimed are defined as follows:

1. An apparatus for burning waste materials including trash, comprising:

a decomposition chamber configured to form a fire pit for controlled decomposition of combustible waste material, said decomposition chamber including an air inlet for allowing controlled input of air to said decomposition chamber to create an oxygen limited burning and decomposition process in said decomposition chamber, said decomposition chamber further including a gaseous by-product outlet positioned generally opposite said air inlet proximate said fire pit for output of combustible gaseous by-products generated by decomposing waste material including hot carbon in said fire pit;

a preheat chamber connected to said decomposition chamber for providing controlled input and preheating of waste material to said decomposition chamber; and an afterburn chamber operably connected to said by-product outlet for burning the combustible gaseous by-products generated in said decomposition chamber, said afterburn chamber being configured to operate with at least a partial vacuum such that the gaseous by-products and other vapors generated in said preheat chamber and said decomposition chamber are drawn generally through the decomposing waste materials including the hot carbon in said decomposition chamber and through said by-product outlet into said afterburn chamber.

2. An apparatus as defined in claim 1 wherein said decomposition chamber includes an upper chamber for receiving the waste material from the preheat chamber and configured to further heat waste material to increasingly elevate temperatures as the waste material moves through said upper chamber toward the fire pit, and further including a fire-pit-forming lower chamber located below said upper chamber.

3. An apparatus as defined in claim 2 including a cover at an inlet to said preheat chamber for preventing uncontrolled ingress of air into said preheat chamber.

4. An apparatus as defined in claim 3 including a material handling mechanism for controlling the flow of waste material into the preheat chamber.

5. An apparatus as defined in claim 3 wherein said preheat chamber includes concentric inner and outer chambers, the inner chamber being configured to contain and direct the movement of the waste material therethrough, the outer chamber defining a space around the inner chamber for receiving heated air to heat the waste material in the inner chamber.

6. An apparatus as defined in claim 1 wherein said decomposition chamber includes a pair of co-rotating drums positioned in a bottom of said decomposition chamber and forming a bottom of said fire pit.

7. An apparatus as defined in claim 6 wherein said drums include a plurality of apertures for allowing controlled amounts of air to pass therethrough into said fire pit.

8. An apparatus as defined in claim 6 wherein a first of said drums includes radially extending paddles forming a plurality of chambers circumferentially around said first drum.

9. An apparatus as defined in claim 6 wherein said drums include first and second drums rotating in common direction.

10. An apparatus as defined in claim 1 wherein said inlet and said by-product outlet of said decomposition chamber are located on opposing sides of said fire pit.

11. An apparatus as defined in claim 1 wherein said decomposition chamber includes a second air inlet located below said fire pit, and including a pair of apertured drums for allowing air to flow from said second inlet through said drums into said decomposition chamber.

12. An apparatus as defined in claim 6 including a variable speed drive operably connected to said co-rotating drums.

13. An apparatus as defined in claim 6 wherein said decomposition chamber includes a trap door cooperating with one of said co-rotating drums for removing non-combustibles and clinkers in said fire pit.

14. An apparatus as defined in claim 1 wherein said afterburn chamber is positioned horizontally adjacent said decomposition chamber, and said by-product outlet in said decomposition chamber is defined by an opening in a common wall shared by said decomposition chamber and said afterburn chamber.

15. An apparatus as defined in claim 1 wherein said afterburn chamber includes a second air inlet for creating turbulence in gases located in said afterburn chamber.

16. An apparatus as defined in claim 1 wherein said afterburn chamber includes an inclined bottom structure for feeding ash away from said by-product outlet.

17. An apparatus as defined in claim 16 wherein said bottom structure includes a plurality of drums rotating in a common rotational direction for feeding ash toward an end of said afterburn chamber.

18. An apparatus as defined in claim 1 including an ash collection device for receiving ash from one of said decomposition chamber and said afterburn chamber.

19. An apparatus as defined in claim 18 wherein said ash collection device includes closure members for maintaining a vacuum therein.

20. An apparatus as defined in claim 1 including an air circulating system for recirculating heated air to said preheat chamber.

21. An apparatus as defined in claim 1 including a roaster operably connected to an exhaust of said afterburn chamber, said roaster being configured to burn combustible materials from trash at an intermediate temperature where the trash also includes metals that are destroyed or made unusable by incineration at an elevated temperature.

22. An apparatus as defined in claim 21 wherein said roaster includes a second air input opening connected to an exhaust of said afterburn chamber and a valve positioned in said second air inlet for controlling flow of air through said roaster.

23. An apparatus as defined in claim 21 wherein said roaster includes a trash receiving chamber having a covered sealed inlet and a gated sealed outlet.

24. An apparatus as defined in claim 1 wherein said afterburn chamber includes an exhaust outlet, and further including a heat exchanger connected to said exhaust outlet for recovering heat from exhaust gases emitted from said afterburn chamber.

25. An apparatus as defined in claim 1 including a material handling system for automatically feeding chopped waste materials into said preheat chamber.

26. An apparatus as defined in claim 1 wherein said preheat chamber includes structure configured to control the free fall of waste material through said preheat chamber.

27. An apparatus as defined in claim 26 wherein said structure includes reciprocatable fingers for dropping the waste material in said preheat chamber at predetermined rates and amounts.

28. An apparatus as defined in claim 26 wherein said preheat chamber, said decomposition chamber, and said afterburn chamber are operated in a partial vacuum.

29. A trash burning apparatus comprising:

a preheat chamber including a material input opening, a cover for sealingly closing the input opening, and at least one gate for controlling the fall of trash fed into said input opening;

a distillation heat chamber connected to said preheat chamber and positioned to receive preheated trash from said preheat chamber, said distillation heat chamber being configured to heat the trash to increasingly elevated temperatures of at least about 200° F. as the trash moves through said distillation heat chamber;

a fire-pit-forming chamber connected to said distillation heat chamber and positioned to receive the trash from said distillation heat chamber, said fire-pit-forming chamber including an air inlet and a gaseous by-product outlet for output of gaseous by-products positioned generally opposite said air inlet; and an afterburn chamber operably connect to said by-product outlet and configured to burn the gaseous by-product generated in said fire-pit-forming chamber from the decomposing trash, said afterburn chamber being configured for operation under a partial vacuum such that the vapors and gaseous by-products generated in said preheat chamber, said distillation heat chamber, and said fire-pit-forming heat chamber are drawn generally through the high temperature decomposing trash in said fire-pit-forming heat chamber into said afterburn chamber for combustion, whereby the gaseous by-products and vapors from the decomposing trash form combustible gases that are readily burnable.

30. A trash burning apparatus as defined in claim 29 wherein said preheat chamber includes concentric inner and outer chambers, the inner chamber being configured to hold and also allow movement of the waste material therethrough, the outer chamber defining a region for receiving heated air to heat the waste material in the inner chamber.

31. A trash burning apparatus as defined in claim 29 wherein said decomposition chamber includes a pair of co-rotating drums positioned in a bottom of said decomposition chamber and forming a bottom of said fire pit.

32. A trash burning apparatus as defined in claim 29 wherein one of said drums includes radially extending paddles forming a plurality of chambers circumferentially around said one drum.

33. A trash burning apparatus as defined in claim 29 including a variable speed drive operably connected to said co-rotating drums.

34. A trash burning apparatus as defined in claim 29 wherein said afterburn chamber includes an air inlet nozzle for creating turbulence in gases located in said afterburn chamber.

35. A trash burning apparatus as defined in claim 29 including a roaster operably connected to an exhaust of said afterburn chamber, said roaster being configured to burn combustible materials from trash at an intermediate temperature where the trash also includes metals that are destroyed or made unusable by incineration at an elevated temperature.

* * * * *